US005771602A

United States Patent [19]

Heikkiläet al.

[11] Patent Number: 5,771,602

[45] Date of Patent: Jun. 30, 1998

[54] METHOD AND DEVICE FOR DRYING A COATING ON A PAPER WEB OR EQUIVALENT

[75] Inventors: Pertti Heikkilä, Raisio; Bertel Karlstedt, Parainen, both of Finland

[73] Assignee: Valmet Corporation, Helsinki, Finland

[21] Appl. No.: 735,691

[22] Filed: Oct. 23, 1996

[30] Foreign Application Priority Data

Oct. 25, 1995 [FI] Finland ..... 955082

[51] Int. Cl.[6] ..... D21F 5/00

[52] U.S. Cl. ..... 34/420; 34/448; 34/461; 34/114; 34/122; 34/640

[58] Field of Search ..... 34/273, 414, 420, 34/422, 425, 448, 460, 461, 114, 122, 130, 640; 226/97, 196; 101/424.1, 487, 488

[56] References Cited

U.S. PATENT DOCUMENTS

| | | | |
|---|---|---|---|
| 4,837,946 | 6/1989 | Hella et al. | 34/156 |
| 4,936,025 | 6/1990 | Heikkila et al. | 34/18 |
| 4,942,674 | 7/1990 | Karlsson | 34/18 |
| 5,009,016 | 4/1991 | Lepisto et al. | 34/41 |
| 5,230,165 | 7/1993 | Beisswanger | 34/60 |
| 5,303,484 | 4/1994 | Hagan et al. | 34/155 |
| 5,561,913 | 10/1996 | Domoto | 34/114 |
| 5,621,983 | 4/1997 | Lundemann et al. | 34/641 |
| 5,636,450 | 6/1997 | Lizé | 34/267 |

FOREIGN PATENT DOCUMENTS

| | | |
|---|---|---|
| 2026045 | 9/1990 | Canada . |
| 2026098 | 9/1990 | Canada . |
| 0507218 | 10/1992 | European Pat. Off. . |
| 0643167 | 3/1995 | European Pat. Off. . |
| 4029487 | 4/1991 | Germany . |
| 4029488 | 4/1991 | Germany . |
| 4415581 | 1/1995 | Germany . |

OTHER PUBLICATIONS

"Trocknung gestrichener Papier" H. Graab, Wochenblatt Fur Papierfabrikation, vol. 17, 1983, pp. 645–648.

INSKO (Insinoorien korlotuskeskus Oy), Phiip Norrdahl and Pertti Heikkila, Paallysteen Kuivatas (Drying of a Coating), 1988.

Abstract of DE 4415581; Paper Web Coating Assembly, Jan. 1995.

*Primary Examiner*—Henry A. Bennett
*Assistant Examiner*—Steve Gravini
*Attorney, Agent, or Firm*—Steinberg, Raskin & Davidson, P.C.

[57] ABSTRACT

A method and device for drying a coating on a paper web or equivalent in which the direction of running of the paper web is turned, free of contact, by blowings produced by a turning device and the coating on the paper web is dried free of contact by blowings of drying devices placed at both sides of the paper web. The direction of running of the paper web is turned by drying blowings. The exhaust air of the turning device and drying device, which is placed at the side of the turning device, is removed from direct vicinity of the paper web or equivalent by a common exhaust device. The turning device and drying device are placed under and within a common box construction so that access of the exhaust air into the surrounding space is prevented. The device includes a turning device for turning the running direction of the paper web free of contact and a drying device for contact-free drying of the coating on the paper web. The turning device and drying device have nozzles for producing blowings and an exhaust-air device for removing the exhaust air from the vicinity of the paper web or equivalent. The device is arranged to produce drying blowings at the turning device. The turning device and the drying device have common exhaust-air members.

26 Claims, 5 Drawing Sheets

METHOD AND DEVICE FOR DRYING A COATING ON A PAPER WEB OR EQUIVALENT

FIELD OF THE INVENTION

The invention relates to a method for drying a coating on a paper web or equivalent, in which the direction of running of the paper web is turned, free of contact, by means of blowings produced by means of a turning device, and the coating on the paper web is dried free of contact by means of the blowings of the drying devices placed at both sides of the paper web.

Further, the invention relates to a device for drying a coating on a paper web or equivalent, which comprises a turning device for turning the running direction of the paper web or equivalent free of contact and a drying device for contact-free drying of the coating on the paper web or equivalent. The turning device and drying device include nozzles for producing blowings and an exhaust-air system for removing the exhaust air from the vicinity of the paper web or equivalent.

BACKGROUND OF THE INVENTION

In some web-coating processes, it is necessary to turn the running direction of the web free of contact after the coating has been applied to the web face but before the coating has solidified or dried. In these processes, it is often, at the same time, necessary to dry the web quickly and efficiently to contact dryness, both for reasons of quality and layout or construction. However, at the same time, the runnability of the web must remain good. As is well known to those skilled in the art, the processes of this type are often carried out by making use of a turning device and infrared dryers and possibly air dryers. In such a case, however, the drying layout will involve some limitations affecting the machine length and required by the process and by the equipment, and at the same time the runnability of the layout suffers. As an example of a problem of this type, it should be mentioned that a free draw of at least about 0.5 meter is necessitated between the turning device and the following dryer, which free draw is usually applied in the constructions currently in use.

With respect to the prior art related to turning and drying arrangements of the type described above, reference is made to Finnish Patent Application No. 943657 (priority from DE 44 00158 and EP 93112 695 and which corresponds to U.S. Pat. No. 5,230,165 incorporated by reference herein) which describes a device for coloring a paper web by means of two rolls arranged as parallel to one another and which form a gap between the rolls so as to pass the paper through this gap. The device is provided with at least one jet printing device in order to apply a color layer onto the mantle faces of the rolls so as to transfer the color layer in the gap between the rolls from the roll mantle face onto one side of the paper web. The device also includes carrier air beams which produce a carrier air cushion between the paper web and the face of the carrier air beam turned towards the paper web. These carrier air beams are arranged so that the direction of the paper web is changed at least once after the gap between the rolls. In this prior art construction, at least one carrier air beam is connected directly after the gap between the rolls, and it is arranged at a distance from the gap formed by the two rolls.

With respect to the prior art, reference can also be made to European Patent Application No. 0 507 218 which describes a dryer section in which the web is turned free of contact by means of a web turning device. The web turning device is followed by dryer devices placed at a distance from the turning device.

Also, with respect to the prior art reference is made to published German Patent Application No. 44 15 581 which describes contact-free air dryers arranged outside the turning sector of a turning roll.

OBJECTS AND SUMMARY OF THE INVENTION

Accordingly, it is an object of the present invention to provide a method and a device for drying a coating on a paper web or equivalent in which most if not all of the drawbacks involved in the prior art have been eliminated or the detrimental effects of these drawbacks have at least been minimized.

It is yet another object of the present invention to provide a new and improved method and device for drying a coating on a paper web or equivalent in which the web is turned and then dried more efficiently than in prior art constructions.

It is still another object of the present invention to provide a new and improved method and device for drying a coating on a paper web or equivalent in which the web is turned and then dried without a significant free draw between the turning stage and the drying stage.

In view of achieving the objects stated above and others, in the method in accordance with the present invention, the direction of running of the paper web or equivalent is turned by means of drying blowings and the exhaust air of a turning device and a drying device placed at the side of the turning device is removed from direct vicinity of the paper web or equivalent by means of a common exhaust device. The turning device and the drying device placed at the side of the turning device are placed under a common box construction whereby access or leakage of the exhaust air into the surrounding space is prevented. Thus, in the method for drying a coating on a paper web whose running path includes a curved segment, heated air is directed at first and second sides of the web from first and second drying devices, respectively, to dry the coating on the web without contact between the first and second drying devices and the web, and a flow of heated air is directed at the web from a turning device along the curved segment in which the web is adapted to run without contact between the turning device and the web. The turning device is situated on the same side of the web as the first drying device and both the first drying device and the turning device are housed within and under a common box construction to isolate the turning device and first drying device from space surrounding the box construction. Exhaust air is thus from an interior of the common box construction in the vicinity of the first drying device and the turning device through the single, common exhaust device.

In the device in accordance with the invention, a turning device for turning the paper web or equivalent and a drying device arranged at the same side of the paper web or equivalent as the turning device are placed under a common box construction, and the device comprises means for producing drying blowings at the turning device. The turning device and the drying device placed under the common box construction with the turning device have common exhaust-air members. Thus, one basic embodiment of the device for drying a coating on a paper web whose running path includes a curved segment, comprises a first housing, a turning device arranged within the first housing and on a first side of the web (and including nozzles for directing blowings at the web along the curved segment in which the web is adapted to run without contact between the turning device and the web,) and drying means for contact-free drying of the coating on the web, i.e., a first drying device situated on the first side of the web and a second drying device situated on a second side of the web opposite the first side of the web whereby each drying device includes nozzles for directing heated blowings at the web. The first drying device is situated within the first housing after the turning device in a running direction of the web. The device also includes a single, common exhaust-air device arranged at least partly in connection with the first housing for removing exhaust air from the vicinity of the turning device and the first drying device.

In accordance with the invention, the drying is carried out most commonly by means of a turning device and an air dryer, and the devices have been constructed physically together as a single unit. In this manner, it is possible to eliminate a part of the free draws present in the prior art layouts, which free draws produce risks of runnability in the prior art arrangements.

In the method and device in accordance with the present invention, both the length of the turning device and the length of the free draw that was present in the prior art arrangements are utilized for drying, in which situation the drying can be started about 1.2 meters to about 1.5 meters earlier than in the prior art.

The method and device in accordance with the invention also permit the use of hot circulation air in the turning devices, because the exhaust air of the turning device is recovered together with the exhaust air of the airborne dryer. In the prior art constructions, in the turning devices, usually cold air taken from the machine hall in which the turning device is situated is employed, in which case the drying effect of the turning device has been negligible. The use of hot air in a conventional turning device results in heat and moisture loads in the hall, it is uneconomical from the point of view of consumption of energy, and it can also be experienced as a risk in view of safety at work.

However, according to the invention, the web turning and drying devices have been combined so that, for reasons of runnability and for reasons of the controllability of air, the common return air zone has been divided into zones, which are provided with a possibility of regulation of the return air. The combination of turning and drying is accomplished either by including the turning function in a conventional airborne dryer box or by providing separate devices with a common, insulated housing, out of which the return air is absorbed.

Since, in the device in accordance with the invention, the turning and drying devices have been combined inside the box of one device, it is possible to provide the feed air of the turning device with a high temperature, i.e., since the heat produced is effectively used to dry the web during the turning stage effected by the turning device. Preferably, the temperature of the feed air of the turning device is about 100° C. to about 300° C. Since the air discharged out of the turning device is absorbed away as return air into the air system, a large quantity of high-temperature air can be removed from the area under control without risking the runnability of the web. At the same time, any risk for safety at work, i.e., to the operators, has been eliminated, which risk would have been produced by the hot air if discharged freely into the machine hall.

The drying portion of the device in accordance with the present invention can follow substantially directly after the turning portion, or after a certain distance if desired for reasons of runnability or layout, as necessary according to the situation. A suitable distance between the turning device and the drying device in an arrangement in accordance with the present invention is typically from about 100 mm to about 700 mm. In this area, according to the invention, functions that promote runnability and/or drying can be positioned, for example drying and/or exhaust-air devices and/or profiling devices or any other, similar devices.

The airborne portion used in connection with the arrangement in accordance with the invention can be accomplished either as a conventional solution in itself known or by means of the high-capacity principle, in which latter case the temperature can be up to about 450° C. and the velocity about 100 meters per second. In other respects, the airborne portion is in itself known in the prior art to a person skilled in the art.

In the arrangement in accordance with the invention, the joint return air of the dryer portion and the turning portion may be used as the feed air for the turning device or as a part of the feed air. Part of the feed air for the turning device can also be taken from the machine hall or from outdoor air, or as air that has been pre-heated in the recovery of heat. This air that is taken from outside, at the same time, operates as the common replacement air for the whole dryer.

In connection with the arrangement in accordance with the invention, the temperature of the feed air for the turning device can be measured and regulated automatically. At the same time, it is possible to verify the air quantity of the turning device and to regulate the quantity of air that is used in the turning device. Also, the extent of vacuum in the combination box can be measured and regulated automatically.

During tail threading operations, the combination is operated preferably so that the turning device portion is in operation so as to secure contact-free turning of the web, but the drying portion has been switched off or switched on to a short circulation. During threading, as the feed air for the turning device, it is possible to use either circulation air or air from the machine hall or outdoor air, or a suitable combination of circulation air and machine-hall/outdoor air.

In other embodiments of the method in accordance with the invention, it is possible to draw exhaust air from the turning device and the drying device on the same side thereas through a return air duct of the single, common exhaust device, mix this exhaust air with air from a machine hall in which the turning device is situated, air from an exterior environment of the machine hall and/or preheated replacement air, and thereafter pass the mixed air into the turning device to constitute the flow of heated air being directed from the turning device at the web. When the common exhaust device is arranged in connection with the first drying device, it is possible to control the flow of exhaust air from the turning device to the single, common exhaust device through a space between the turning device and the first drying device. In another embodiment, the flow of exhaust air from the turning device into the common exhaust device and the flow of exhaust air from the first drying device into the common exhaust device are independently regulated. The air being passed to the turning device should have a temperature of from about 25° C. to about 300° C. while the air being directed from the first and second drying devices should be provided with a temperature in a range from about 100° C. to about 450° C., and a velocity of from about 20 to about 100 meters per second. Other air circulation routes to the turning device include circulating air through the first and second drying devices, and either directing at least a portion of the air circulating through the first and second drying devices into the turning device or mixing the air circulating through the first and second drying devices in a certain ratio with air from a machine hall in which the turning device is situated, air from an exterior environment of the machine hall and/or pre-heated replacement air, directing the mixed air into the turning device, and regulating the-temperature of the flow of heated air being directed from the turning device by controlling the mixing ratio.

In other embodiments of the device in accordance with the invention the common exhaust-air device includes a return air duct through which exhaust air is passed and the device then includes air-feed means for feeding air to the turning device which comprise means for receiving at least a portion of the exhaust air from the return air duct, means for receiving air from a machine hall in which the turning device is situated, from an exterior environment of the machine hall, or pre-heated replacement air, and means for mixing the portion of the exhaust air from the return air duct, the air from a machine hall in which the turning device is situated, from an exterior environment of the machine hall, or pre-heated replacement air.

In the following, the invention will be described in more detail with reference to the figures in the accompanying drawing. The invention is, however, not strictly confined to the details of the illustrated embodiments.

BRIEF DESCRIPTION OF THE DRAWINGS

The following drawings are illustrative of embodiments of the invention and are not meant to limit the scope of the invention as encompassed by the claims.

DETAILED DESCRIPTION OF THE PREFERRED EMBODIMENTS

Figure 1:
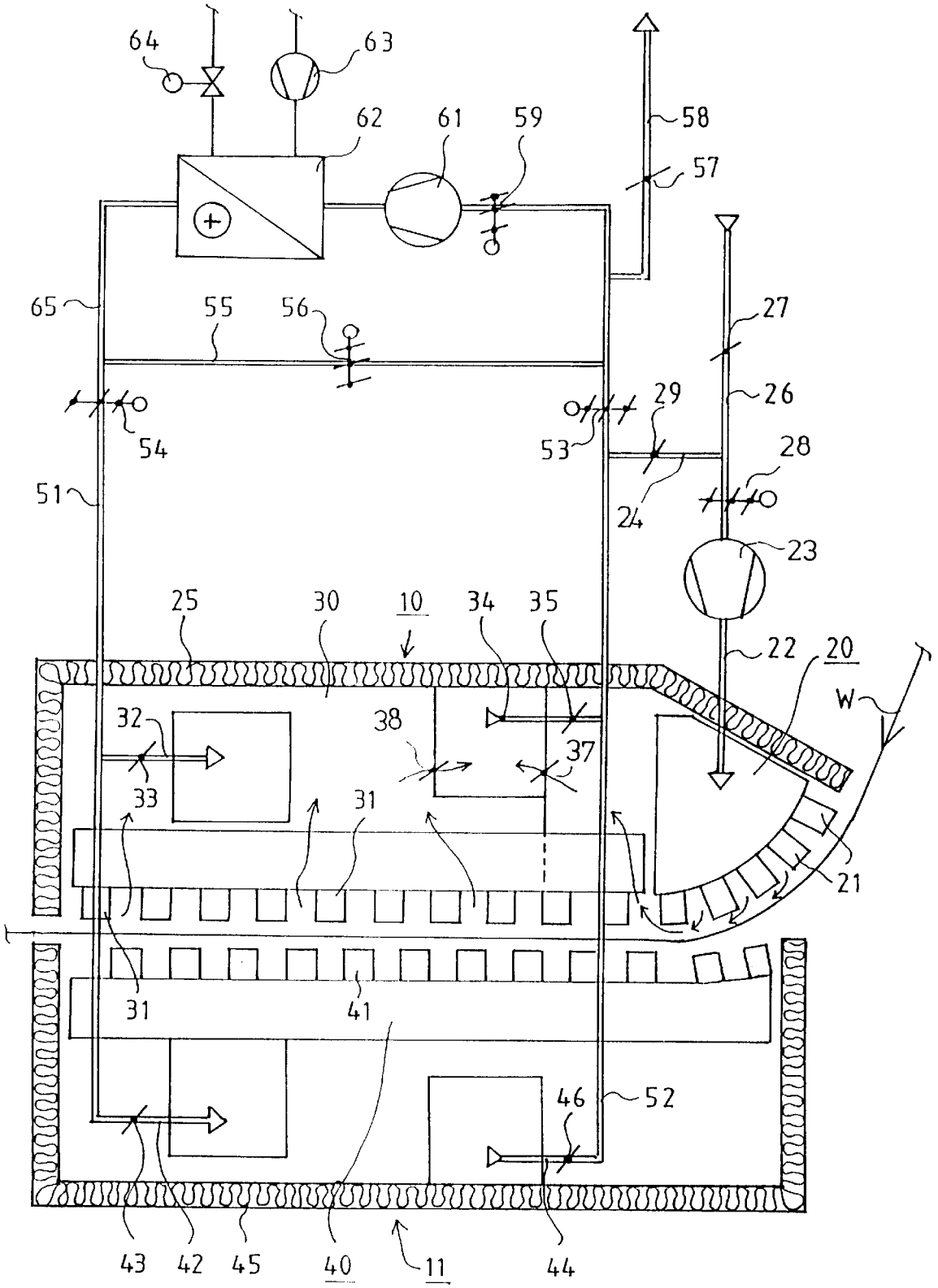
FIG. 1 is a schematic illustration of an exemplifying embodiment of the device in accordance with the invention and in which the method in accordance with the invention may be applied.

Referring to the accompanying drawings wherein the same reference numerals refer to the same or similar elements, as shown in FIG. 1, an equipment unit 10 is placed above a moving paper web W and comprises a housing or box 25 having an interior in which a web turning device 20 and a dryer 30 are situated. The dryer 30, which is also referred to as the upper dryer, is arranged substantially directly after the turning device. The turning device 20 comprises a curved section having nozzles 21 from which air is blown for contact-free turning of the web W so that the path of the web W has a curved segment over the turning device 20. The dryer 30 comprises a substantially linear section having nozzles 31 from which air is blown for drying the coating on the web W. Between the nozzles 31 in the dryer 30, there are exhaust openings through which the moist exhaust air is removed from between the web W and the dryer 30. The air fed by the turning device 20, i.e., directed therefrom to turn the web, is also removed from the area of the nozzles 31 of the dryer 30, preferably through the exhaust openings in the initial end. Below the paper web W, there is a drying device 40 which has a substantially linear section in opposed relationship to the linear section of the dryer 30 and is provided with nozzles 41. Between the nozzles, there are exhaust openings for removal of the moist air. From the nozzles 41, hot air is blown at the lower face of the web in order to dry the coating on the lower face of the paper web W. The lower dryer is also enclosed inside an insulated box construction 45. The dimensions of the lower dryer 40 are such that it extends to the area of the upper dryer 30, i.e., in opposed relationship thereto, and partly or fully also to the area of the turning device, i.e., in opposed relationship thereto. Air is passed into the turning device 20 from a duct 22 by means of a blower 23, although other air supply and blower means can be utilized.

Air can be passed into the turning device 20 from outside the system along a duct 26 having a regulation plate arranged in association therewith denoted by reference numeral 27. At the turning device 20, combined return air of the drying device and the turning device is used, which return air is passed along a duct 24 through a regulation plate 29 situated in association with duct 24. To the dryers 30 and 40, drying air is passed through respective ducts 32 and 42. The dryer-specific latticework gates for the air feed are denoted by the reference numerals 33 and 43.

To provide heated air for drying of the coating, air is passed into a burner system through a combustion-air blower 63, and the gas flow to a burner unit 62 is regulated by means of a regulation valve 64. From the burner unit 62, the heated air is passed further along a duct 51 to the dryers 30 and 40, duct 51 being coupled to ducts 32 and 42. Hot drying air can also be passed through the duct 55 to a short circulation route by opening the closing latticework gate 56 and at the same time closing the closing latticework gates 54 and 53, whereby the heated drying air will not be passed into the dryers 30,40. The short circulation is used during such interruptions in production during which it is not justified to shut down the entire system.

The return air from the upper and lower dryers 30 and 40 is passed from the ducts 44 and 34 through the regulating latticework gates 35 and 46, respectively, into a duct 52, from which it can be passed to the turning device through a regulation gate 29 and/or as exhaust air through a regulation gate 57 into an exhaust duct 58 and/or as return circulation through a guide blade regulator 59 to a blower 61 which passes the return air back to circulation. By means of regulating latticework gates 37 and 38, it is possible to regulate the balance between the exhaust airs of the dryer 30 and the turning device 20 and by means of this balance, it is possible to influence the runnability of the web in the area between the dryer and the turning device. In the feed of air to the turning device 20, a regulating lattice-work gate 28 is arranged before the blower 23.

Figure 2:
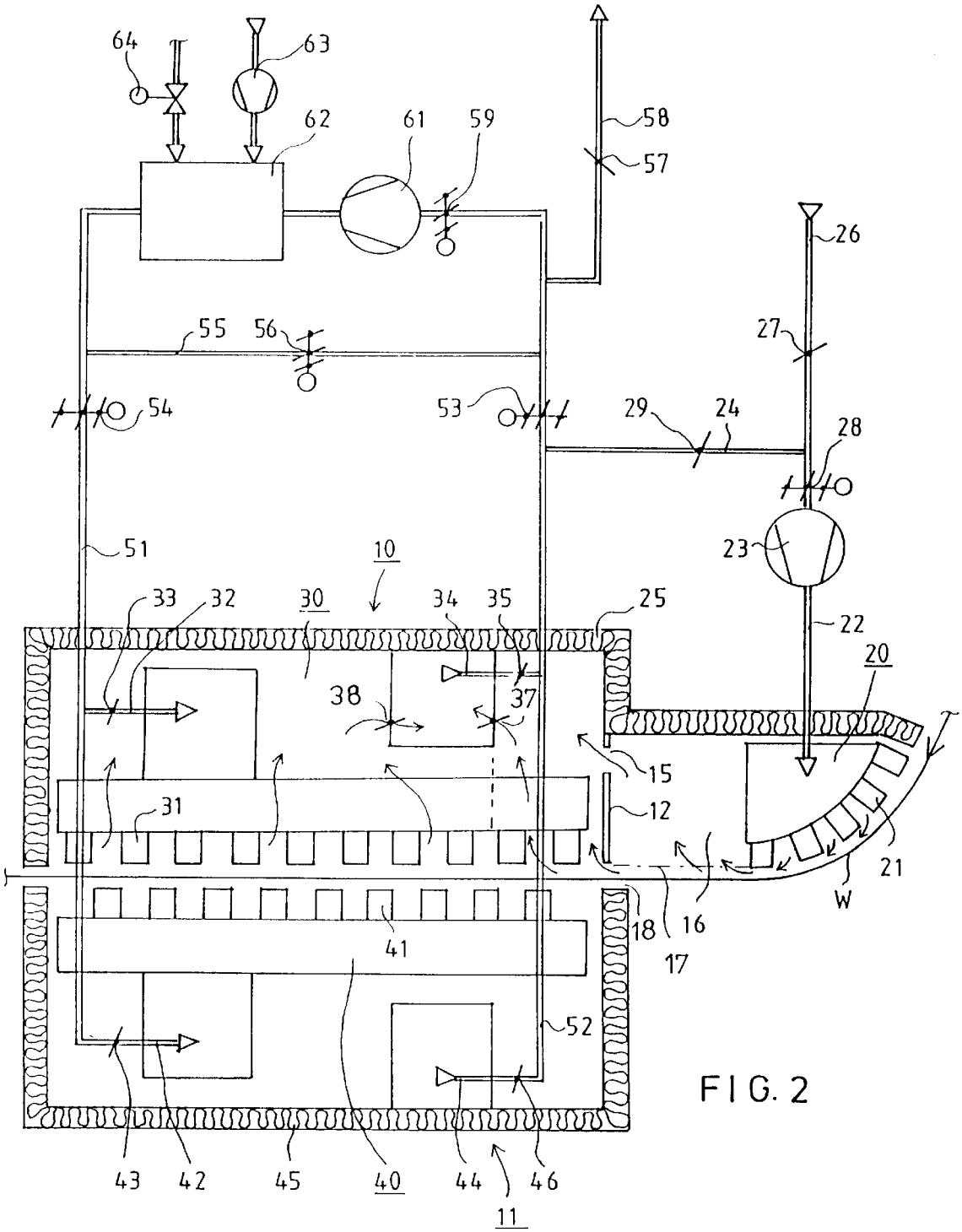
FIG. 2 shows a second exemplifying embodiment of the device in accordance with the invention and in which the method in accordance with the invention may be applied.

The exemplifying embodiment shown in FIG. 2 is substantially similar to that shown in FIG. 1, and the same reference numerals refer to corresponding parts. When compared with the exemplifying embodiment shown in FIG. 1, it is a difference in the exemplifying embodiment shown in FIG. 2 that a space or gap 16 is arranged between the turning device 20 and the dryer 30, through which gap exhaust air is passed from the turning device 20 to an outlet 34 of the dryer 30. Thus, the dryer 30 is not arranged immediately directly after the turning device 20 as in the embodiment shown in FIG. 1. However, the turning device 20 and the dryer 30 are placed inside the same box 25, and between the turning device portion 20 and the dryer portion 30, a partition wall 12 is arranged. Partition wall 12 is provided with an opening 15 through which exhaust air is passed in order to enhance the arrangements of runnability and in order to control the exhaust arrangements. By passing part of the exhaust air of the turning device through the opening 15, air flows detrimental in view of the runnability of the web are substantially avoided. The lower dryer 40 corresponds to that shown in FIG. 1, except that it extends only to the area of the upper dryer 30 (and not under the turning device or the gap), even though it can also extend up to the area of the turning device if so desired. The gap between the tuning device 20 and the dryer 30 and between a portion of the box 25 and the web W can be covered with a perforated plate, net, or equivalent 17 in order to prevent passage of pieces of paper along with the return air into the opening 15.

Figure 3:
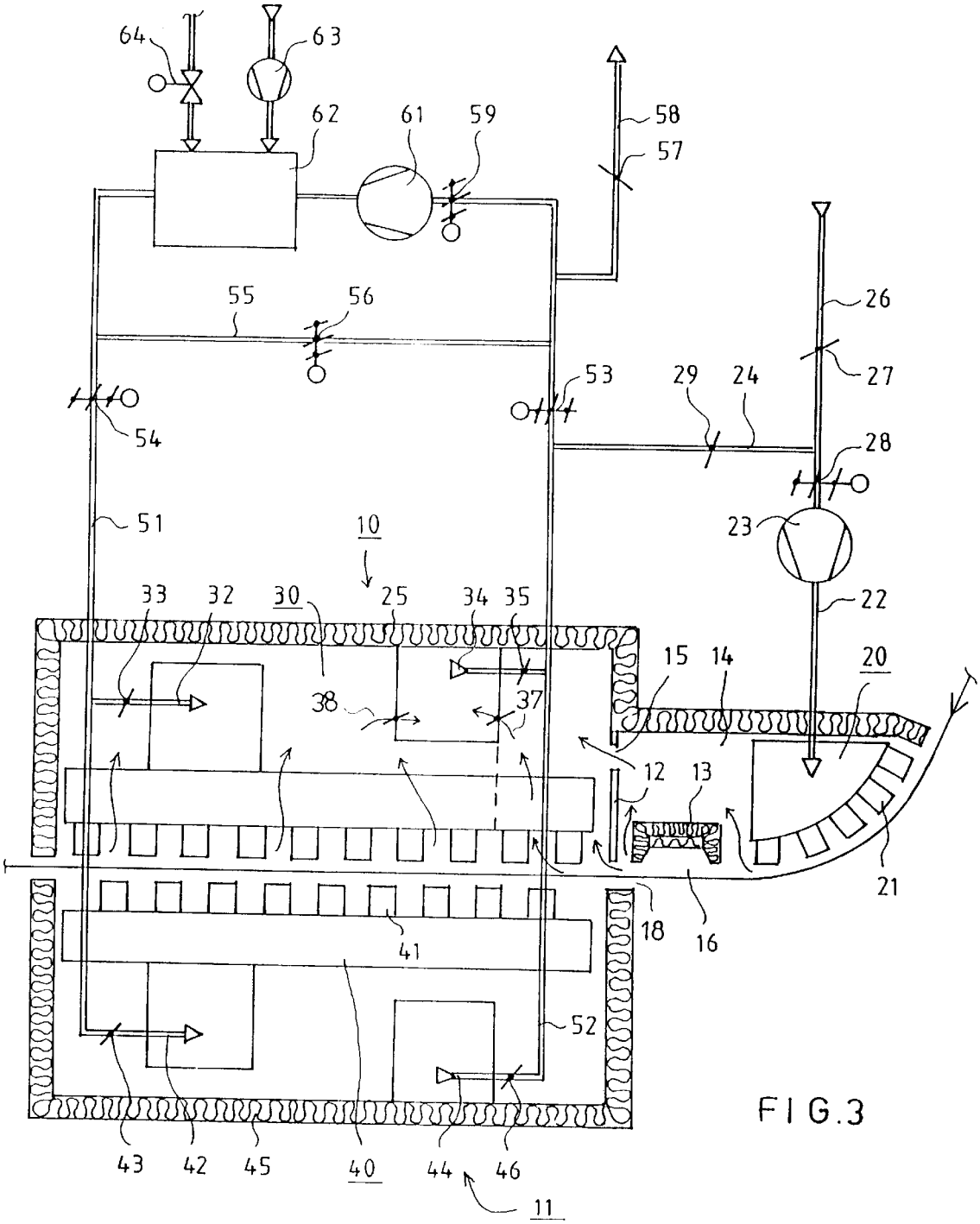
FIG. 3 is a schematic illustration of a third exemplifying embodiment of the device in accordance with the invention and in which the method in accordance with the invention may be applied.

The exemplifying embodiment shown in FIG. 3 is similar to those shown in FIGS. 1 and 2, and the same reference numerals refer to corresponding parts. When compared with the exemplifying embodiment shown in FIG. 2, in this exemplifying embodiment an additional dryer 13 is situated in the space 16 between the turning device 20 and the dryer device 30. The additional dryer 13 dries the web W during this gap, and the dryer can be, for example, an infrared dryer as illustrated which may constitute a profiling unit. In this embodiment, the exhaust air of the turning device 20 are passed from both sides of the infrared dryer 13 and from behind the partition wall to the outlets of the dryer 30 as well as through the space 14 above the infrared dryer 13, through the opening 15 provided in the partition wall 12, to the outlet of the dryer. The lower dryer 40 is similar to the lower dryer shown in FIG. 2.

Figure 4:
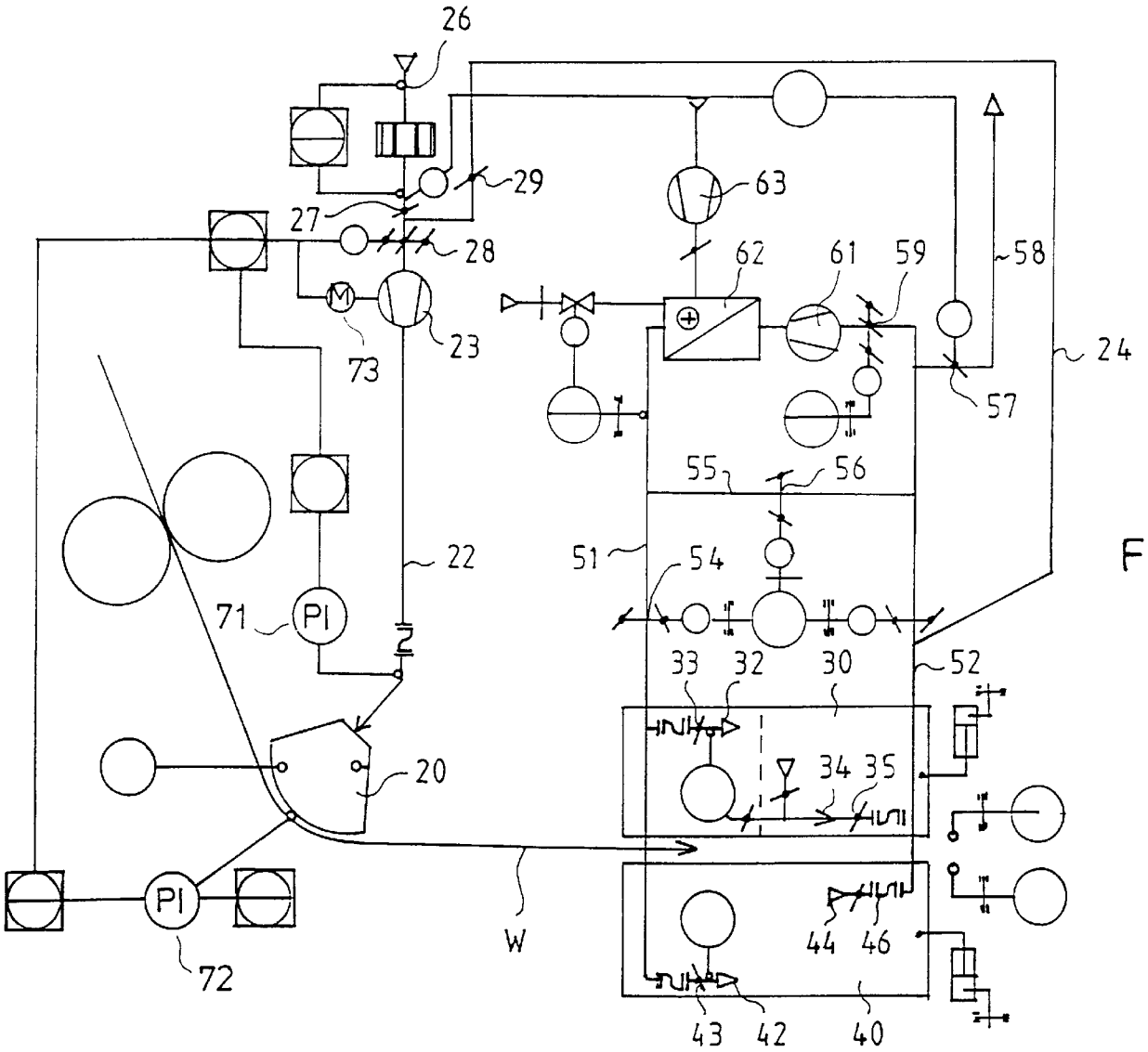
FIG. 4 shows an exemplifying embodiment of a PI diagram of the device in accordance with the invention and in which the method in accordance with the invention may be applied.

The PI diagram shown in FIG. 4 shows one mode of arranging the automation as well as the arrangement of the control of the process and the dryer. In FIG. 4, the same reference numerals are used as in FIGS. 1–3 for corresponding parts. The quantity of air for the turning device is regulated either by means of a guide blade regulator 28 or by regulation means 73 which are arranged to regulate the number of revolutions of the blower. The quantity of air is controlled based on measurements of the pressures of the air cushion 72 between the web and the nozzles of the turning device and the intake air 71, so that a sufficient and desired pressure and thickness of air cushion are obtained in view of the desired turning of the web.

The quantity of the replacement air directed into the turning device, which air comes from the machine hall, from outdoor air, or which is pre-heated air, is regulated by means of a regulation plate 27. The quantity of the exhaust air of the dryer is regulated by means of the regulation plate 57. By means of regulation of the proportions of these two plates, the air balance of the dryer unit is ensured.

The other regulations and regulation parameters of the airborne dryer comply with the traditional principle of regulation employed in corresponding conventional airborne dryers.

Figure 5A:
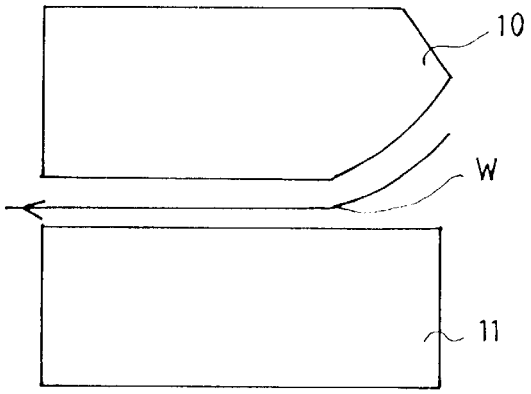
Figures 5A–5D are schematic illustrations of some exemplifying embodiments of opening of the device of the present invention for the time of threading of the web.
Figure 5B:
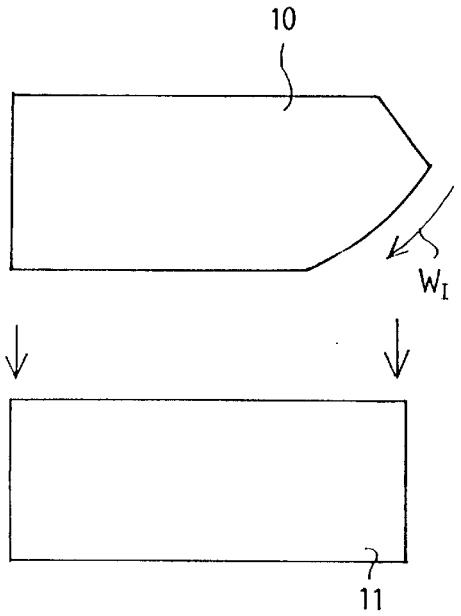
Figure 5C:
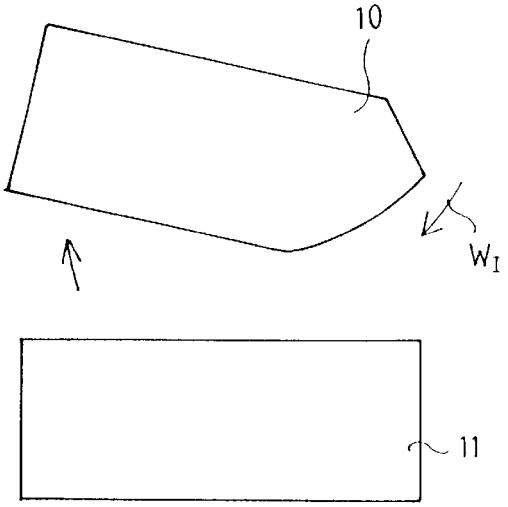
Figure 5D:
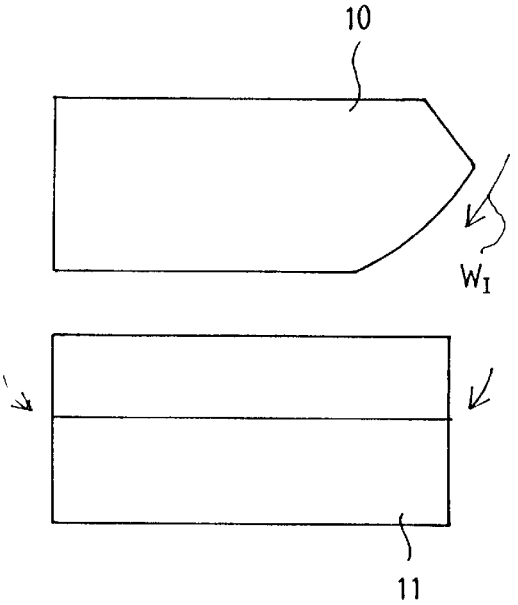

FIG. 5A is a schematic illustration of an arrangement of equipment in accordance with the invention, in which the upper part is denoted with the reference numeral 10 and the lower part with the reference numeral 11. The paper web W runs between the parts free of contact, in which connection the coating on the paper web W is dried and the web is turned. FIGS. 5B–5D show some possibilities of opening the assembly of equipment for the time of threading a tail W, of the web W. In the exemplifying embodiment shown in FIG. 5B, the lower device 11 is shifted in a direction parallel downward, for example, along guides (not shown) arranged in the frame constructions. In the exemplifying embodiment shown in FIG. 5C, the upper equipment unit 10 is pivoted upward around a center point of the turning device portion, in which connection the turning of the web remains correct during the threading, but the dryer does not affect the threading of the web. In the arrangement shown in FIG. 5D, the edge of the lower device 11 either at the driving side or at the tending side is provided with hinges, and the device is pivoted open around this hinge axis for tail threading of the web.

The examples provided above are not meant to be exclusive. Many other variations of the present invention would be obvious to those skilled in the art, and are contemplated to be within the scope of the appended claims. For example, although several specific type of air regulation devices are shown for the ducts and air flows, i.e., the regulation gates or plates, it should be understood that other air regulation means are equally appropriate in the device and method in accordance with the invention without deviating from the scope and spirit thereof.

We claim:

1. A method for drying a coating on a paper web whose running path includes a curved segment, comprising the steps of:

directing heated air at the web from a first drying device arranged on a first side of the web, directing heated air at the web from a second drying device arranged on a second side of the web and at least partially in opposed relationship to said first drying device, directing a flow of heated air at the web along the curved segment from a turning device arranged on the first side of the web such that the web is adapted to run along the curved segment without contact between the turning device and the web, arranging the first drying device and the turning device under a common box construction to isolate the turning device and first drying device from space surrounding the box construction, and removing exhaust air from an interior of the common box construction in the vicinity of the first drying device and the turning device through a single, common exhaust device.

2. The method of claim 1, further comprising the steps of:

drawing the exhaust air from the first drying device and the turning device through a return air duct of the single, common exhaust device, mixing the exhaust air flowing through the return air duct with air from a machine hall in which the turning device is situated, air from an exterior environment of the machine hall and/or pre-heated replacement air, and passing the mixed air into the turning device to constitute the flow of heated air being directed from the turning device at the web.

3. The method of claim 1, further comprising the steps of:

arranging the single, common exhaust device in connection with the first drying device, and controlling the flow of exhaust air from the turning device to the single, common exhaust device through a space between the turning device and the first drying device.

4. The method of claim 1, further comprising the steps of:

arranging the first drying device substantially directly after an end of the turning device in the running direction of the web, and arranging a portion of the second drying device in opposed relationship to the end of the turning device.

5. The method of claim 1, further comprising the steps of:

arranging the single, common exhaust device in connection with the first drying device, and spacing the first drying device from the turning device such that the web travels through an intermediate space between the turning device and the first drying device, at least a part of the exhaust air from the turning device being drawn through the intermediate space into the single, common exhaust device through openings situated between the intermediate space and the first drying device and/or through an opening provided for the web between the first and second drying devices.

6. The method of claim 1, further comprising the step of:

independently regulating the flow of exhaust air from the turning device into the single, common exhaust device and the flow of exhaust air from the first drying device into the single, common exhaust device.

7. The method of claim 1, further comprising the steps of:

arranging the single, common exhaust device in connection with the first drying device, spacing the first drying device from the turning device such that the web travels through an intermediate space between the turning device and the first drying device, arranging a partition wall to define a side of the intermediate space adjacent the first drying device, and reducing air flows in an opening provided for the web between the first and second drying devices by passing at least a part of the exhaust air from the turning device through the intermediate space and an opening in the partition wall.

8. The method of claim 1, further comprising the steps of:

arranging the single, common exhaust device in connection with the first drying device, spacing the first drying device from the turning device such that the web travels through an intermediate space between the turning device and the first drying device, drying the coating of the web in the intermediate space by means of an infrared radiator positioned in the intermediate space and within common box construction.

9. The method of claim 8, wherein the infrared radiator constitutes a profiling unit.

10. The method of claim 1, further comprising the step of:

feeding air to the turning device having a temperature of from about 25° C. to about 300° C. to thereby constitute the flow of heated air being directed from the turning device at the web.

11. The method of claim 1, further comprising the steps of:

providing the air being directed from the first and second drying devices with a temperature in a range from about 100° C. to about 450° C., and directing the air from the first and second drying devices at a velocity of from about 20 to about 100 meters per second.

12. The method of claim 1, further comprising the steps of:

circulating air through the first and second drying devices, and directing at least a portion of the air circulating through the first and second drying devices into the turning device to constitute the flow of heated air being directed from the turning device at the web.

13. The method of claim 1, further comprising the steps of:

circulating air through the first and second drying devices, and mixing the air circulating through the first and second drying devices in a certain ratio with air from a machine hall in which the turning device is situated, air from an exterior environment of the machine hall and/or pre-heated replacement air, directing the mixed air into the turning device to constitute the flow of heated air being directed from the turning device at the web, and regulating the temperature of the flow of heated air being directed from the turning device at the web by controlling the mixing ratio.

14. The method of claim 1, further comprising the steps of:

feeding heated air to the first and second drying devices, mixing a portion of the heated air being fed to the first and second drying devices with air from a machine hall in which the turning device is situated, air from an exterior environment of the machine hall and/or pre-heated replacement air, and directing the mixed air into the turning device to constitute the flow of heated air being directed from the turning device at the web.

15. The method of claim 1, further comprising the step of:

constructing the first drying device to be pivotable around a center point of the turning device away from the web during tail threading of the web.

16. The method of claim 1, further comprising the step of constructing the second drying device to be shiftable away from the web during tail threading of the web.

17. The method of claim 1, further comprising the step of constructing the second drying device to be pivotable away from the web around an edge of the second drying device parallel to the machine direction during tail threading of the web.

18. The method of claim 1, wherein the step of directing heated air at the web from the first drying device comprises the steps of:

arranging nozzles in the first drying device, heating air prior to said nozzles in a flow path of the air, and passing the heated air through said nozzles; and the step of directing heated air at the web from the second drying device comprises the steps of:

arranging nozzles in the first drying device, heating air prior to said nozzles in a flow path of the air, and passing the heated air through said nozzles.

19. The method of claim 1, wherein the step of directing the flow of heated air at the web from the turning device comprises the steps of:

arranging nozzles in the turning device, heating air prior to said nozzles in a flow path of the air, and passing the heated air through said nozzles.

20. The method of claim 1, wherein the run of the web has a substantially straight segment after the curved segment, the first and second drying devices being arranged to define a gap therebetween through which the web runs in said straight segment.

21. An apparatus for drying a coating on a paper web whose running path includes a curved segment, comprising:

a first drying device arranged on a first side of the web, said first drying device being structured and arranged to direct heated air at the web, a second drying device arranged on a second side of the web and at least partially in opposed relationship to said first drying device, said second drying device being structured and arranged to direct heated air at the web, a turning device arranged on the first side of the web, said turning device being structured and arranged to direct a flow of heated air at the web along the curved segment such that the web is adapted to run along the curved segment without contact between the turning device and the web, a common box construction under which said first drying device and said turning device are arranged and isolated from space surrounding said box construction, and a single, common exhaust device arranged in connection with said first drying device and said turning device and structured and arranged to remove construction in the vicinity of said box construction in the vicinity of said first drying device and said turning device.

22. The apparatus of claim 21, wherein said single, common exhaust-air device comprises a return air duct through which exhaust air is passed, further comprising air-feed means for feeding air to said turning device, said air-feed means comprising means for receiving at least a portion of the exhaust air from the return air duct, means for receiving air from a machine hall in which said turning device is situated, from an exterior environment of the machine hall, or pre-heated replacement air, and means for mixing the portion of the exhaust air from the return air duct, the air from a machine hall in which said turning device is situated, from an exterior environment of the machine hall, or pre-heated replacement air.

23. The apparatus of claim 21, wherein said single, common exhaust device is arranged in connection with said first drying device, further comprising control means for controlling the flow of exhaust air from the vicinity of said turning device to said single, common exhaust device.

24. The apparatus of claim 21, wherein said first drying device is arranged directly after said turning device without a substantial space therebetween.

25. The apparatus of claim 21, wherein said first drying device is arranged at a distance from said turning device.

26. The apparatus of claim 25, further comprising an infrared radiator for heating the web arranged between said turning device and said first drying device, said infrared radiator being arranged within said first housing.

* * * * *

UNITED STATES PATENT AND TRADEMARK OFFICE

CERTIFICATE OF CORRECTION

PATENT NO. : 5,771,602

DATED : June 30, 1998

INVENTOR(S) : Pertti HEIKKILÄ, et al

It is certified that error appears in the above-identified patent and that said Letters Patent is hereby corrected as shown below:

On the cover page underneath "United States Patent" change "Heikkiläet al." to –Heikkilä et al.–.

Signed and Sealed this

Eighth Day of September, 1998

*Attest:*

*Attesting Officer*

Bruce Lehman

BRUCE LEHMAN

*Commissioner of Patents and Trademarks*